US005370211A

United States Patent [19]

Plana

[11] Patent Number: 5,370,211

[45] Date of Patent: Dec. 6, 1994

[54] COIN-WHIRLING DEVICE FOR ARCADE GAME MACHINE

[75] Inventor: Salvio Plana, Drummondville, Canada

[73] Assignee: Gerald Duhamel, Drummondville, Canada

[21] Appl. No.: 70,841

[22] Filed: Jun. 3, 1993

[51] Int. Cl.[5] ..... G07F 1/04

[52] U.S. Cl. ..... 194/344

[58] Field of Search ..... 194/344, 347, 348, 349; 193/DIG. 1

[56] References Cited

U.S. PATENT DOCUMENTS

| | | | |
|---|---|---|---|
| 1,196,574 | 8/1916 | Millard | 194/344 X |
| 2,430,658 | 11/1947 | Andres | 194/344 X |

FOREIGN PATENT DOCUMENTS

| | | | |
|---|---|---|---|
| 747700 | 12/1966 | Canada | 194/347 |
| 2617311 | 12/1988 | France | 194/344 |
| 2-183890 | 7/1990 | Japan | 194/344 |

*Primary Examiner*—F. J. Bartuska

*Attorney, Agent, or Firm*—Pierre Lespérance; François Martineau

[57] ABSTRACT

A coin whirling device for use in a coin-operated arcade game machine, the arcade game machine being of the type having a housing provided with a coin intake slit, for feeding discoid money coins into the enclosure defined within the housing and about a first plane, and a coin processor, located within the housing enclosure and operatively connected to the coin intake slit. The coin whirling device consists of a vertical cylinder, for capturing a coin fed into the housing. An axial slit in the cylinder opens into an upper end recess, being made up of two downwardly inclined oblique surfaces orthogonal to one another on opposite sides of the slit. These top leading surfaces will bias an incoming coin, oriented transversely thereof, to spin upon strike from the first plane to a second plane at right angle to the above-noted first plane. The coin whirling device provides compactness to the arcade game machine housing with respect to its dimensions along the first-mentioned plane, namely, its width.

3 Claims, 3 Drawing Sheets

COIN-WHIRLING DEVICE FOR ARCADE GAME MACHINE

FIELD OF THE INVENTION

This invention relates to coin-operated machines used in arcade-game public premisses, and more particularly to the coinfeeding and processing mechanism within the housing of these arcade game machines.

BACKGROUND OF THE INVENTION

With arcade type coin-operated machines, it is desirable to optimize available ground space, to provide best return on the investment for the owner of these machines. Indeed, these arcade game machines often require only small money change for initial, time-limited play of the computer game software, but are usually located in downtown areas of cities where the rental cost per square meter of ground space tends to be high.

It is thus desirable that the arcade type machines be as narrow in width as possible, ideally about as narrow as the youth player sitting in front thereof. The depth or indeed the height dimensional values of the machine are not as critical as the width value thereof, as one skilled in the art will readily understand.

A problem with reducing the width of these machines is the relatively large volume of the coin processing mechanism located within the machine housing. To keep costs down, the coin fed into the machine through the external coin slot, is usually conveyed to the coin processing means through simple, gravity-borne forces. Such coin conveying system imposes a structural constraint to the coin processing means, in that the relatively large coin processing means body then needs to project laterally, imposing a minimum width dimension limitation to the machine. Whirling the coin processing system within the machine housing is of course possible, but only at the expense of a more expensive coin conveying means (for conveying the coins from the coin intake slit to the coin processing means).

OBJECT OF THE INVENTION

Accordingly, it is the gist of the invention to provide simple, low cost means to narrow the lateral dimensions of arcade type, coin-operated arcade game machines, by introducing a coin whirling device that spins through a right angle a money coin fed through the coin intake slit of the machine, before the coin reaches the coin processing system of the machine.

SUMMARY OF THE INVENTION

According to the objects of the invention, there is disclosed a coin whirling device for use in a coin-operated arcade game machine, said arcade game machine being of the type having a housing provided with a coin intake means, for feeding discoid coins into the enclosure defined within said housing and about a first plane, and a coin processing means, located within said housing enclosure and operatively connected to said coin intake means; said coin whirling device consisting of: (a) means for capturing a coin fed into said housing by said coin intake means; (b) means for biasing said captured coin to whirl from said first plane to a second plane at right angle to said first plane; and (c) means for directing said whirled coin toward and into said coin processing means, within said second plane; whereby said coin whirling means provides compactness to said arcade game machine housing with respect to its dimensions along said first plane, namely, its width.

Preferably, said biasing means is enabled through gravity-borne forces.

DETAILED DESCRIPTION OF THE INVENTION

Figure 1:
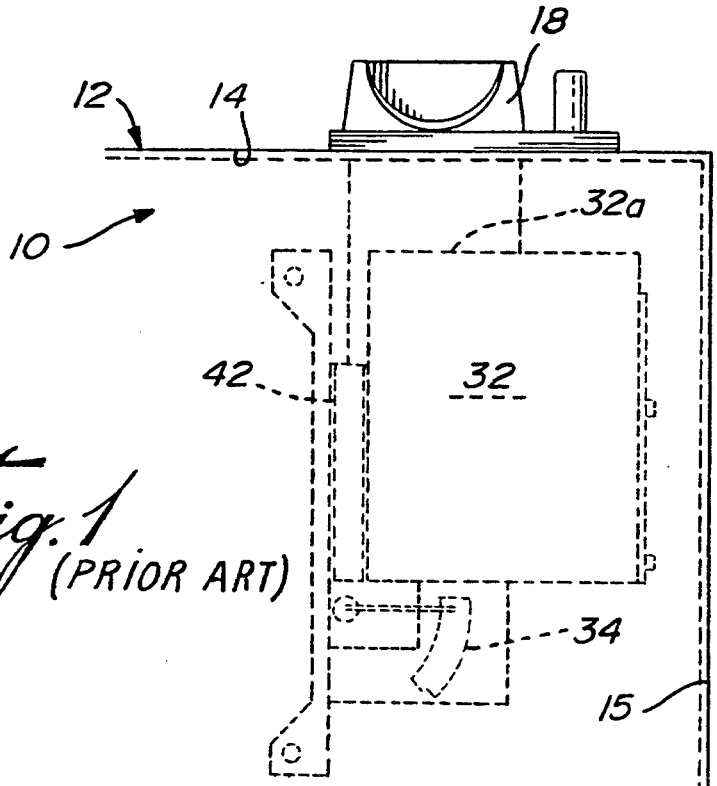
Fig. 1 (PRIOR ART)
FIG. 1 is a schematic, partial, front elevational view of a conventional coin-operated arcade game machine, in phantom lines, with the coin intake mouthpiece shown in full lines and the coin processing means casing extending laterally.
Figure 2:
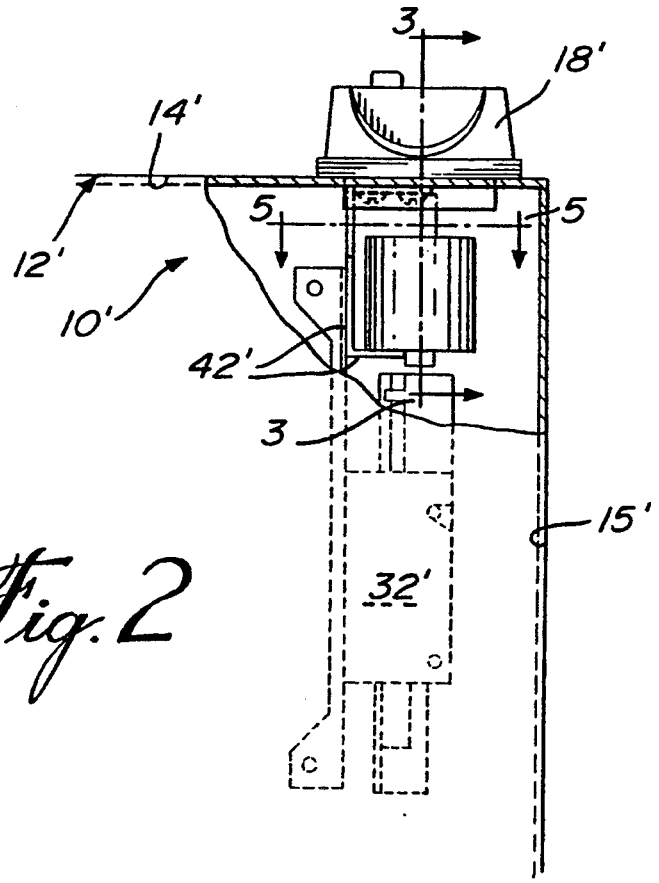
FIG. 2 is a view similar to FIG. 1, but further showing the coin whirling device of the invention in operative position, and the coin processing means casing extending in a fore and aft direction.

Arcade game machine 10 defines a closed housing 12 including a horizontal top wall 14 and a lateral side wall 15. Top wall 14 includes a slit 16 (FIGS. 3–4) engaged by a rigid mouthpiece 18 anchored therein in the known fashion. Mouthpiece 18 is of generally T-shape in cross-section (FIG. 4), defining two lateral, opposite, horizontal legs 20, 22, an upright leg 24, and a downwardly depending lip 26 coextensive with leg 24. Legs 20 and 22 abut flatly against the outer free face of wall 14. Lip 26 extends through and downwardly beyond slit 16. Leg or plate 24 includes an arcuate recess 28 about its upper edge portion, for conformingly receiving a discoid (money) coin C. Plate 24 and lip 26 further include a thin, coextensive channel member 30, dimensioned to slidingly receive a coin C. The plane of coin channel member 30 extends at right angle from that of lateral side wall 15, and defines a top coin inlet 30*a*, within recess 28 of outer plate 24, and a bottom coin outlet 30*b*, at the bottom end of inner lip 26.

The coin receiving, thin, coin intake channel 32*a* of a known coin processing means 32 is provided beneath coin outlet 30*b*, in vertical register therewith. Coins C are gravity-fed from upper recess 28, through intermediate channel 30 and into coin processing means 32. Channel 32*a* must be parallel to channel 30, which means that a relatively important horizontal clearance is required between coaxial channels 30 and 32*a*, and lateral side wall 15. Coin processing means 32 includes a CPU (not shown) that computes whether the required amount of money has been fed to the arcade game machine, and if yes, that sends a timer-controlled ENABLE command to a release means 34 for a selected computer software program, to load same onto RAM memory for interactive play by the youth operator.

Of course, other types of coin-operated machines could also be envisioned to benefit from the present invention, e.g. foodstuff holding vending machines.

According to the invention, coin whirling means 36 are provided, to whirl through a right angle a coin C exiting from channel outlet 30b, whereby the planar body of said coin C shifts from a plane orthogonal to the machine lateral side wall 15', within mouthpiece 18, to a plane parallel to this lateral side wall 15', downstream of the coin whirling means 36. Coin whirling means 36 operates under gravity-borne forces, to whirl the incoming coin.

Figure 6:
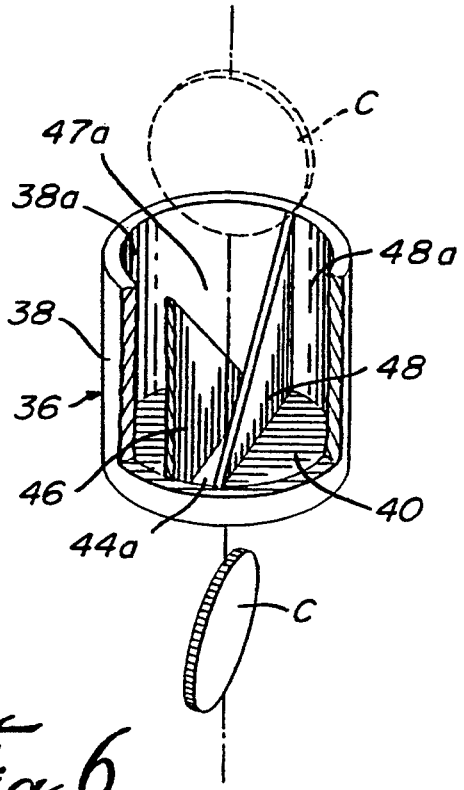
FIG. 6 is a cut away perspective view of the coin whirling device.

A preferred embodiment of coin whirling means 36 is illustrated in FIG. 6. Means 36 consists of a cylindrical body 38, defining a top open mouth 38a and a bottom wall 40 closing the bottom end of body 38. Cylinder 38 is anchored to a machine wall (e.g. wall 14) by bracket means 42, in coaxial alignment with channel 30 of upper mouthpiece 18. A slit 44 is made through floor 40, about a plane orthogonal to that of channel 30. The width of channel 30 and slit 44 is only slightly greater than the thickness of the largest coin of money C to engage into recess 28, while the length thereof is only slightly longer than the diameter of the diametrally largest coin to engage mouthpiece 18.

Two triangular plates 46, 48 are mounted and anchored in upright position over wall 40, on the two opposite edgewise portions of slit 44. Upright plates 46, 48 are therefore parallel to one another and to the machine lateral side wall 15', and define a channel 50 therebetween for free passage of a coin C exiting from outlet 30b. The top edges 47, 49 of plates 46, 48 form inclined diverging leading edges, against which an incoming (vertically falling) coin C is destined to impact under gravity-borne forces. The parallel planes of plates 46, 48 are orthogonal to the plane of mouthpiece channel 30.

Figure 4:
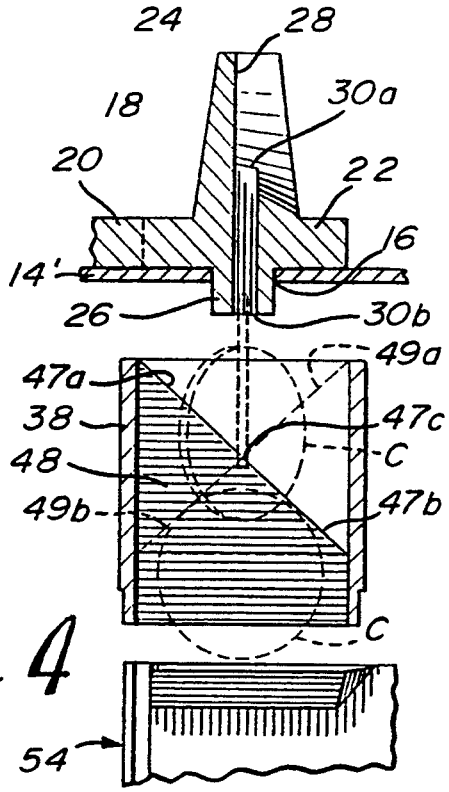
FIG. 4 is a view similar to FIG. 3, but rotated at right angle.
Figure 5:
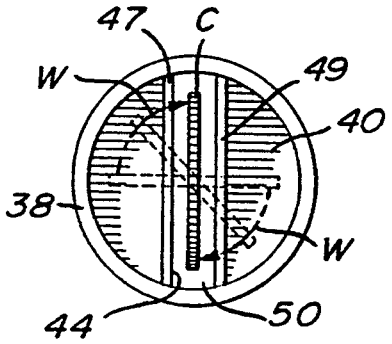
FIG. 5 is an enlarged top plan view from perspective 5 of FIG. 2.

As best illustrated in FIG. 4, a longitudinal sectional view through channel 50 of cylinder 38 reveals that the upper sections 47a, 49a of plates leading edges 47, 49 form a generally V-shape, defining an intermediate horizontal axis where two sections 47c, 49c of the leading edges 47, 49 come in transverse (horizontal) register with one another. The virtual horizontal line joining dots 47c, 49c extends transversely of the planes of plates 46 and 48. Housing 38 is further precisely positioned with respect to mouthpiece 18, so that horizontal line 47c, 49c become exactly coplanar with the thin, vertical coin channel 30 of the mouthpiece.

In view of the above-noted spatial arrangement and because plate leading edges 47, 49 extend in opposite directions, incoming coin C will be biased—upon striking impact against the intermediate sections 47c, 49c of leading edges 47, 49—to spin into channel 50.

Coin whirling occurs, because discoid coin C, by transversely striking edgewisely both intermediate, transversely registering sections 47c, 49c, of inclined leading edges 47, 49, will be whirlingly biased by its own weight to sink further and slide—about opposite peripheral edge portions thereof—along the lower portions 47b, 49b of the top leading edges 47, 49 of plates 46, 48.

Due to this configuration of whirl means body 38, 46, 48, coins C will not normally engage into any one of the two pockets 56, 58, defined above flooring 40, within cylinder 38 and radially outwardly of the lower portions 47b, 49b respectively of plates 46, 48. Coins C will not engage into pockets 56, 58 because the coin impacting points 47c, 49c of the plates leading edges 47, 49, are located at a level beneath that of the top mouth of vertical cylinder 38. That is to say, the top portions 47a, 49a of plates 46, 48 will prevent the coin C from escaping from channel 50.

However, it is recognized that in some countries, the mouthpiece 18, which does not form as such a part of the invention, may have a non standard format, whereby channel 30 inside the mouthpiece 18 would be deep enough to concurrently receive two coins side by side. That is to say, the depth of channel 30 would then be greater than the combined thickness of a pair of coins. Then, one of the two coins falling onto the V-disposed whirl-inducing leading edge surfacess 47a, 49a, might be undesirably drawn outwardly from channel 50, following impact on plates leading edges 47a, 49a away from the intermediate edge sections 47c, 49c, to fall for example into one of the radially outward pockets 56 or 58 and onto flooring 40 within cylindrical body 38.

This coin swaying motion away from channel 50 cannot be ruled out, since at least one of the two coins will strike a section of V-disposed leading edge upper portions 47a, 49a located away from the intermediate points 47c, 49c, as illustrated in FIG. 4 with the upper coin in dashed outline. The impacting point could then be limited to only one of the two leading edge 47, 49, for example about the top corner of leading edge upper portion 47a or 49a.

To prevent this outcome from occurring, it is envisioned, within the scope of the present invention and as illustrated in FIGS. 3a, 4a, 5a and 6a, to completely fill these prior pockets 56, 58, with a suitable rigid filler, from flooring 40 up to the oblique level of edges 47, 49 respectively. Otherwise, some pieces of coins C fed to mouthpiece 18 might get trapped into cylinder 38 and never reach the coin processing means 54—a source complaint from the customer, to be sure.

Figure 3:
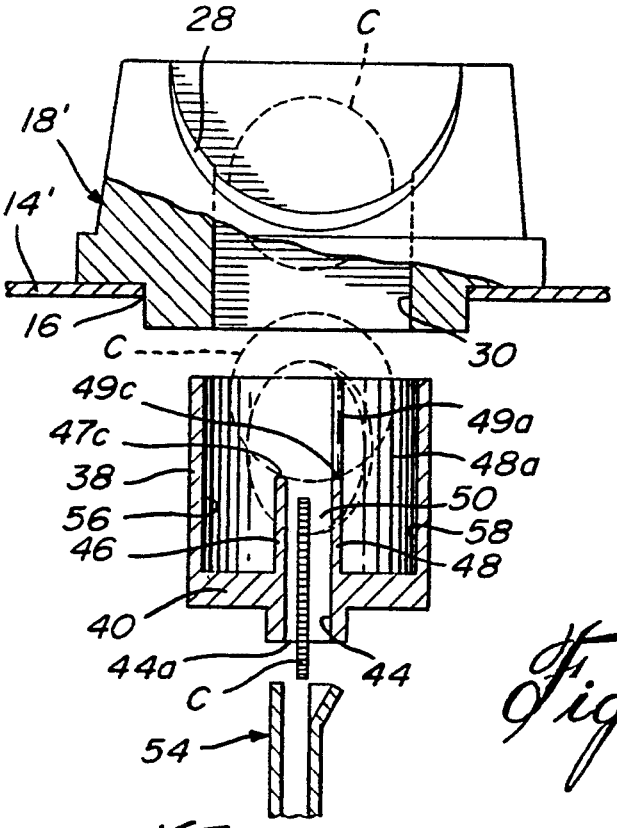
FIG. 3 is an enlarged sectional view about line 3—3 of FIG. 2.
Figure 3A:
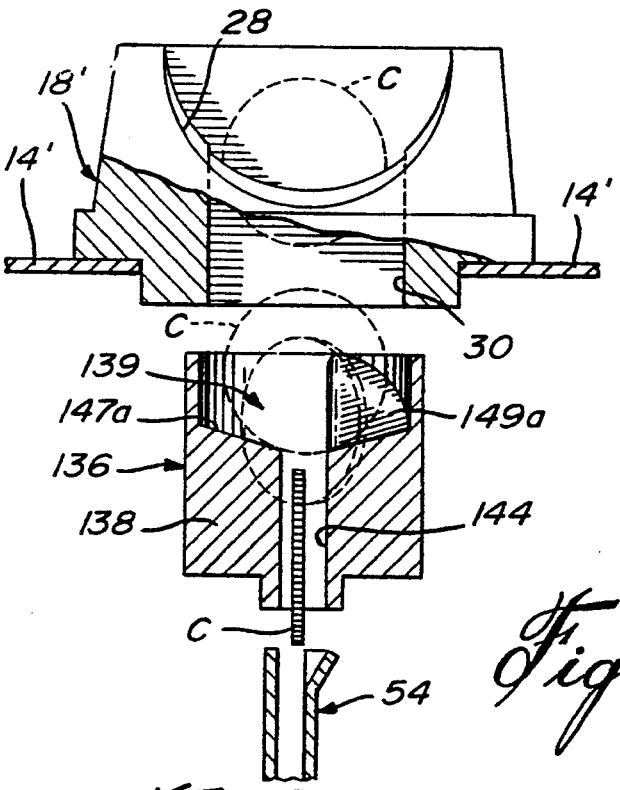
FIGS. 3*a*, 4*a*, 5*a* and 6*a* are views similar to FIGS. 3, 4, 5 and 6, respectively, but for an alternate embodiment of invention.
Figure 4A:
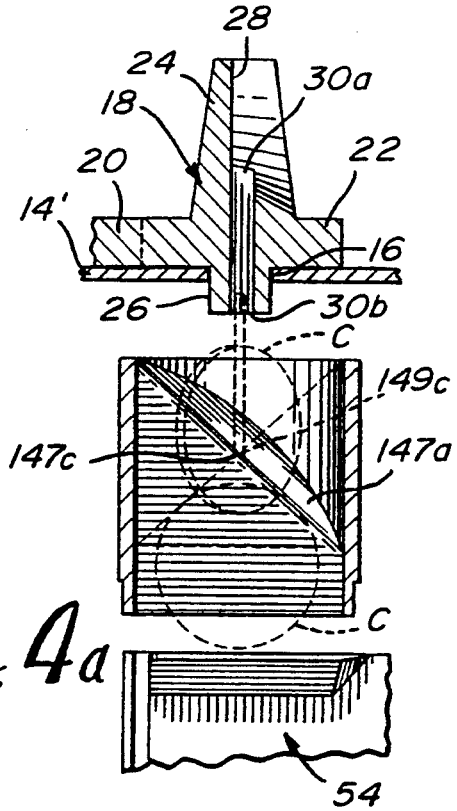
Figure 5A:
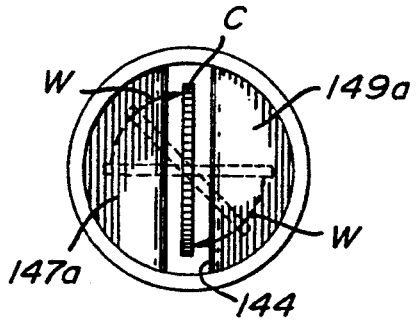
Figure 6A:
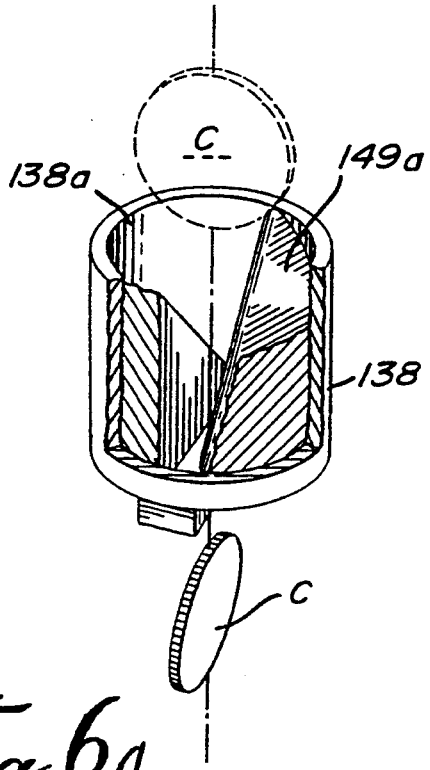

More particularly, plates 47, 49 from FIGS. 3 and 4 now transversely merge with cylinder body 38, as best seen in FIG. 3a. Hence, as shown in FIG. 3a and 4a, alternate coin whirling means 136 consists of a full cylinder 138, provided with an axial coin slit 144 opening into an enlarged upper end recess 139 (FIG. 3a). Recess 139 is formed of two downwardly inclined cut-out wall surfaces 147a, 149a, being made obliquely of the cylinder axial slit 144 about planes orthogonal to one another (as suggested in FIG. 4a). Thus, should a single coin C fall through mouthpiece slit 30, coin C should strike about the transversely intersecting sections 147c, 149c, of oblique walls 147a, 149a, (FIG. 3), to whirl into coin inlet 144; whereas should two or more coins C fall concurrently from mouthpiece 18, or should the vertical axis of fall of coin C be transversely offset from the axial slit 144, then, at least one coin will strike one wall 147a, 149a at a horizontal level above that of horizontally registering wall sections 147c, 149c, but below the top edge 138a of cylinder 138, thus again biasing the coin into a whirling motion (see arrow W) to eventually engage coin slit 144 under gravity-borne forces.

It is understood that, alternately, cylindrical body 138 of FIGS. 3a, 4a, could be hollow rather than full, provided there remains the upper oblique surfaces 147a, 149a, mergingly closing the upper end mouth of cylinder 138 but for slit 144.

After coin whirling with the present whirling means 47, 49, in accordance with the teachings of the invention, coin C can thereafter escape into channel 44, 50, and outwardly therefrom through bottom outlet 44a.

A coin receiving channel member 54 is positioned beneath cylinder 38, coplanar to channel 50 to be engaged by coins C. Channel member 54 forms part of the coin processing means 32' discussed hereinabove. Channel member 54 is to be substantially parallel to lateral side wall 15' of arcade game machine 10', whereby the depth of machine 10'—i.e. the distance between the front and rear walls thereof—will be smaller than that of a conventional coin operated arcade game machine 10. The reason for this compactness is that the coin processing means 32' is oriented in a more efficient way, compared to prior art coin processing means 32.

I claim:

1. A coin whirling device for use in a coin-operated arcade game machine, said machine being of the type having a housing provided with a coin intake means, for feeding discoid coins into the enclosure defined within said housing and about a first plane, and a coin processing means, located within said housing enclosure and operatively connected to said coin intake means; said coin whirling device consisting of:

(a) means for capturing a coin fed into said housing by said coin intake means and consisting of a cylindrical body defining an inner diameter, the latter being only slightly greater than the diameter of said discoid coin, said cylindrical body to be positioned vertically at a location intermediate that of said coin intake means and coin processing means, said cylindrical body defining a coin engaging top inlet and a coin escaping bottom outlet;

(b) means enabled through gravity-borne forces for biasing said captured coin to whirl from said first plane to a second plane at right angle to said first plane; and (c) means for directing said whirled coin toward and into said coin processing means, within said second plane; with said coin whirling means providing compactness to said arcade game machine housing with respect to its dimensions along said first plane;

wherein said coin directing means consists of a pair of parallel plates, carried axially within said cylindrical body, said parallel plates defining therebetween a vertical channel, extending within said second plate, and defining top and bottom ends; said channel being wider than the thickness of one said discoid coin but narrower than the diameter of said one discoid coin, for free passage of the coin therethrough with a coin orientation limited to said second plane; said biasing means further biasing said coin through said channel top end into said channel.

2. A coin whirling device as defined in claim 1, wherein said biasing means is embodied into top leading edges defined by said parallel plates, said top edges being downwardly inclined in opposite directions; a section of each said leading edges coming in respective transverse register with one another along a horizontal axis located intermediate said inlet and outlet ends of cylindrical body; whereby said discoid coin is to edgewisely impact said plates leading edges transversely registering sections, under gravity-borne forces, and to thereafter whirl and concurrently sink into said channel, through progressive edgewise coin sliding motion along the lower portions of said downwardly inclined leading edges of the whirling means plates.

3. A coin whirling device for use in a coin-operated arcade game machine, said machine being of the type having a housing provided with a coin intake means, for feeding discoid coins into the enclosure defined within said housing and about a first plane, and a coin processing means, located within said housing enclosure and operatively connected to said coin intake means; said coin whirling device consisting of:

(a) means for capturing a coin fed into said housing by said coin intake means and consisting of a cylindrical body defining an inner diameter, the latter being only slightly greater than the diameter of said discoid coin, said cylindrical body to be positioned vertically at a location intermediate that of said coin intake means and coin processing means, said cylindrical body defining a coin engaging top inlet and a coin escaping bottom outlet;

(b) means enabled through gravity-borne forces for biasing said captured coin to whirl from said first plane to a second plane at right angle to said first plane; and (c) means for directing said whirled coin toward and into said coin processing means, within said second plane; with said coin whirling means providing compactness to said arcade game machine housing with respect to its dimensions along said first plane;

wherein said coin directing means consists of a pair of downwardly inclined wall surfaces, opening freely upwardly of said cylindrical body top inlet, said pair of wall surfaces being obliquely oriented relative to said cylindrical body vertical axis and being orthogonal to one another, said pair of wall surfaces merging with the peripheral wall defined by said cylindrical body and spaced by a vertical channel located therebetween, said vertical channel extending within said second plane and defining top and bottom ends; said channel being wider than the thickness of one said discoid coin but narrower than the diameter of said one discoid coin, for free passage of the coin therethrough with a coin orientation limited to said second plane; said biasing means further biasing said coin through said channel top end into said channel.

* * * * *